US011351086B2

(12) United States Patent
Härdig et al.

(10) Patent No.: US 11,351,086 B2
(45) Date of Patent: Jun. 7, 2022

(54) CPR CHEST COMPRESSION MACHINE

(71) Applicant: PHYSIO-CONTROL, INC., Redmond, WA (US)

(72) Inventors: Bjarne Madsen Härdig, Lund (SE); Marcus Ehrstedt, Kävlinge (SE)

(73) Assignee: PHYSIO-CONTROL, INC., Redmond, WA (US)

( * ) Notice: Subject to any disclaimer, the term of this patent is extended or adjusted under 35 U.S.C. 154(b) by 685 days.

(21) Appl. No.: 16/162,966

(22) Filed: Oct. 17, 2018

(65) Prior Publication Data

US 2019/0117499 A1 Apr. 25, 2019

Related U.S. Application Data

(60) Provisional application No. 62/575,979, filed on Oct. 23, 2017.

(51) Int. Cl.
*A61H 31/00* (2006.01)

(52) U.S. Cl.
CPC .... *A61H 31/005* (2013.01); *A61H 2201/0119* (2013.01); *A61H 2201/0173* (2013.01); *A61H 2201/5035* (2013.01); *A61H 2201/5069* (2013.01); *A61H 2201/5097* (2013.01); *A61H 2205/084* (2013.01)

(58) Field of Classification Search
CPC ..... A61H 31/005; A61H 2201/0119; A61H 2201/0173; A61H 2201/5035; A61H 2201/5069; A61H 2201/5097; A61H 2205/084
See application file for complete search history.

(56) References Cited

U.S. PATENT DOCUMENTS 4,361,140 A * 11/1982 Barkalow ..... A61H 31/006 601/106
7,569,021 B2 * 8/2009 Sebelius ..... A61H 31/008 601/41
8,888,725 B2 * 11/2014 Parascandola ..... A61H 31/00 601/41
9,750,661 B2 9/2017 Lurie
9,813,568 B2 11/2017 Fujii et al.
(Continued)

*Primary Examiner* — Kendra D Carter
*Assistant Examiner* — Jonathan S Paciorek
(74) *Attorney, Agent, or Firm* — Miller Nash LLP

(57) ABSTRACT

Embodiments of a Cardio-Pulmonary Resuscitation ("CPR") device are disclosed. A CPR device can include a compression mechanism configured to perform successive CPR compressions on a chest of a patient, the compression mechanism including a support portion configured to be placed underneath a patient, a piston, and a contact surface configured to make contact with the chest at a first orientation with respect to the support portion; and a controller communicatively coupled with the compression mechanism. The controller can be configured to receive at least one input and determine whether the first orientation of the contact surface should be adjusted based on the at least one input. The controller can further, responsive to a determination that the first orientation of the contact surface should be adjusted, cause the contact surface to move so that the contact surface makes contact with the chest at a second orientation with respect to the support portion.

13 Claims, 5 Drawing Sheets

(56) References Cited

U.S. PATENT DOCUMENTS

| | | | | |
|---|---|---|---|---|
| 2004/0162587 | A1* | 8/2004 | Hampton | A61H 31/008<br>607/5 |
| 2010/0198118 | A1* | 8/2010 | Itnati | A61H 31/004<br>601/41 |
| 2016/0058660 | A1* | 3/2016 | Lurie | A61H 31/006<br>601/41 |
| 2016/0143804 | A1* | 5/2016 | Nilsson | A61H 31/006<br>601/41 |

* cited by examiner

CPR CHEST COMPRESSION MACHINE

CROSS REFERENCE TO RELATED PATENT APPLICATIONS

This patent application claims priority from Provisional Patent Application Ser. No. 62/575,979, filed on Oct. 23, 2017, the contents of which are incorporated herein by reference in their entirety.

BACKGROUND

In certain types of medical emergencies a patient's heart stops working. This stops the blood flow, without which the patient may die. Cardio Pulmonary Resuscitation (CPR) can forestall the risk of death. CPR includes performing repeated chest compressions to the chest of the patient so as to cause their blood to circulate some. CPR also includes delivering rescue breaths to the patient. CPR is intended to merely maintain the patient until a more definite therapy is made available, such as defibrillation. Defibrillation is an electrical shock deliberately delivered to a person in the hope of correcting their heart rhythm.

Guidelines by medical experts such as the American Heart Association provide parameters for CPR to cause the blood to circulate effectively. The parameters are for aspects such as the frequency of the compressions, the depth that they should reach, and the full release that is to follow each of them. The depth is sometimes required to exceed 5 cm (2 in.). The parameters also include instructions for the rescue breaths.

Traditionally, CPR has been performed manually. A number of people have been trained in CPR, including some who are not in the medical professions just in case. However, manual CPR might be ineffective, and being ineffective it may lead to irreversible damage to the patient's vital organs, such as the brain and the heart. The rescuer at the moment might not be able to recall their training, especially under the stress of the moment. And even the best trained rescuer can become quickly fatigued from performing chest compressions, at which point their performance might be degraded. Indeed, chest compressions that are not frequent enough, not deep enough, or not followed by a full decompression may fail to maintain blood circulation.

The risk of ineffective chest compressions has been addressed with CPR chest compression machines. Such machines have been known by a number of names, for example CPR chest compression machines (CCCM), mechanical CPR devices, cardiac compressors and so on.

CPR chest compression machines repeatedly compress and release the chest of the patient. Such machines can be programmed so that they will automatically compress and release at the recommended rate or frequency, and can reach a specific depth within the recommended range. Some of these machines can even exert force upwards during decompressions. Sometimes the feature can even pull the chest higher than it would be while at rest—a feature that is called active decompression.

The repeated chest compressions of CPR are actually compressions alternating with releases. They cause the blood to circulate some, which can prevent damage to organs like the brain. For making this blood circulation effective, guidelines by medical experts such as the American Heart Association dictate suggested parameters for chest compressions, such as the frequency, the depth reached, fully releasing after a compression, and so on. The releases are also called decompressions.

At present, most CPR chest compression machines repeat the same type of compressions over and over, pressing each time at the same location of the patient chest. This precise consistency is non-physiologic and may miss an opportunity to better move blood through each part of the patient's circulatory systems.

There remain challenges. Sometimes, due to the repeated and forceful compressions, the body's position may shift within the CPR chest compression machine, in which case the compressions may become less effective. The body's shifting, seen from the perspective of the body, can be characterized as the CPR machine shifting, or a piston migrating or walking, etc.

Mechanical CPR machines today either press with a piston-based solution or a belt-driven solution on the chest during a cardiac arrest to revitalize the patient with the help of a suction cup, hard plate, or belt. Many of these solutions work fine if the device is placed correctly in the middle of the chest of the patient and the patient has the heart placed somewhat to the left of the chest. But, if placed poorly, the devices do not press the heart as they should to get the right compressions during the cardiac arrest.

Mechanical chest compression devices can be challenging to put on the patient, and getting the piston or plunger having a contact surface to be positioned at the intended point on the chest is not easy. Once the device is applied, if the initial positioning was not correct, readjusting its position while the weight of a large patient presses down on the back plate is not easy. Furthermore, the chest compression device can creep in one direction or another during operation, moving it to a suboptimal position and thus requiring adjustment. Also, it is likely that the optimal position for a chest compression device is different from one patient to another.

Additionally, each patient has a sternum with a different tilt angle, or sternal angle, between the lower part of the sternum (towards the feet) and the upper part of the sternum (towards the head). The fact that the sternum is at an angle means that the sternum will swing when performing chest compressions, manually or with a CCCM. Furthermore, the sternum will move different distances depending on the location along the sternum that contact for a compression is made. If the pressure for the compression is strictly perpendicular, even if a CCCM is set to perform compressions at a depth of 5 cm, the inner movement (deflection of the sternum) will be different in different patients depending on the length and angle of the sternum, the size of the pressure point and the pressure point's location from the sternum's fulcrum during a compression. Additionally, the sternal angle can change during a CPR session. There is therefore a risk of performing too deep of compressions or too shallow of compressions.

BRIEF SUMMARY

An exemplary embodiment of a Cardio-Pulmonary Resuscitation ("CPR") device can include a compression mechanism configured to perform successive CPR compressions on a chest of a patient, the compression mechanism including a support portion configured to be placed underneath a patient, a piston, and a contact surface configured to make contact with the chest at a first orientation with respect to the support portion; and a controller communicatively coupled with the compression mechanism. The controller can be configured to receive at least one input and determine whether the first orientation of the contact surface should be adjusted based on the at least one input. The controller can further, responsive to a determination that the first orientation of the contact surface should be adjusted, cause the contact surface to move so that the contact surface makes contact with the chest at a second orientation with respect to the support portion.

In some embodiments, the at least one input includes a physiological parameter sensor signal from a physiological parameter sensor for sensing a physiological parameter of a patient. In some embodiments, the at least one input includes an input provide by a user. Additionally and/or alternatively, the compression mechanism can include a pressure sensor configured to generate a pressure sensor signal, the pressure sensor signal representative of contact with a patient's chest at the first orientation, and further wherein the at least one input includes the pressure sensor signal.

In some embodiments, the CPR device includes a contact member pivotally attached to the piston, wherein the contact surface is disposed on the contact member. The CPR device can further include an angle sensor, wherein the piston includes a piston center axis and the angle sensor is configured to sense the orientation of the contact surface with respect to the piston center axis.

In some embodiments, the CPR device includes at least one leg pivotally attached to the support portion, wherein the at least one leg has a first position and a second position, further wherein at the first position the contact surface is configured to make contact with a patient's chest at the first orientation and at the second position the contact surface is configured to make contact with a patient's chest at the second orientation. The CPR device can further include an angle sensor configured to sense the orientation of the at least one leg with respect to the support surface.

Some embodiments of a CPR device can include a piston having a piston center axis, a driver coupled to the piston configured to extend and retract the piston, and a contact member pivotally attached to the piston, the contact member having a contact surface configured to make contact with a patient's chest at a first orientation with respect to the piston center axis and at a second orientation with respect to the piston center axis. In some embodiments, the contact member includes a suction cup. Additionally and/or alternatively, some embodiments include an angle sensor is configured to sense the orientation of the contact surface with respect to the piston center axis. Additionally and/or alternatively, some embodiments include a controller configured to receive at least one input, determine whether the orientation of the contact surface with respect to the piston center axis should be adjusted based on the at least one input, responsive to a determination that the contact surface should be adjusted, cause the contact surface to move from the first orientation to the second orientation. Additionally and/or alternatively, the contact member can include a pressure sensor configured to generate a pressure sensor signal, the pressure sensor signal representative of contact with a patient's chest at the first orientation.

Some embodiments of a CPR device can include a support portion configured to be placed underneath a patient, a compression mechanism configured to perform successive CPR compressions on a chest of a patient, the compression mechanism including a piston and a contact surface, and at least one leg pivotally attached to the support portion, wherein the at least one leg has a first position and a second position, further wherein at the first position the contact surface is configured to make contact with a patient's chest at a first orientation with respect to the support portion and at the second position the contact surface is configured to make contact with a patient's chest at a second orientation with respect to the support portion. Additionally and/or alternatively, some embodiments include an angle sensor configured to sense an angle of the at least one leg with respect to the support portion. Additionally and/or alternatively, some embodiments include a controller configured to receive at least one input, determine whether the orientation of the contact surface with respect to the support portion should be adjusted based on the at least one input, responsive to a determination that the contact surface should be adjusted, cause the at least one leg to move from the first position to the second position. Additionally and/or alternatively, some embodiments include a pressure sensor configured to generate a pressure sensor signal, the pressure sensor signal representative of contact with a patient's chest at the first orientation.

These and other features and advantages of this description will become more readily apparent from the following Detailed Description, which proceeds with reference to the drawings.

DETAILED DESCRIPTION

The present disclosure relates to CPR chest compression machines, methods and software that can perform automatically a series of Cardio-Pulmonary Resuscitation ("CPR") chest compressions on a patient and can accommodate different patient sternal angles. Embodiments are now described in more detail.

Figure 1:
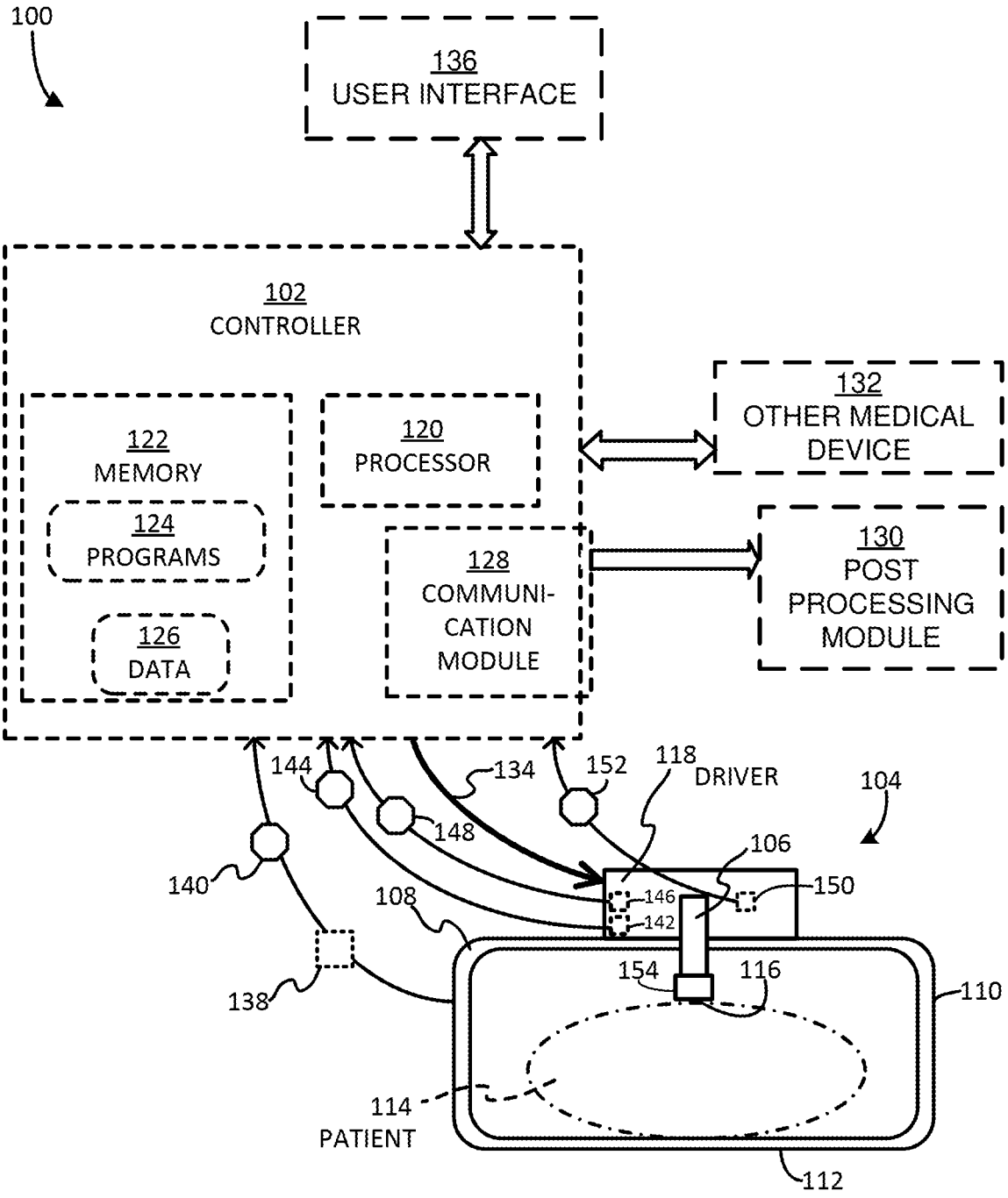
FIG. 1 is a diagram of components of an abstracted CPR chest compression system according to the present disclosure.

FIG. 1 illustrates an example schematic block diagram of a mechanical CPR device 100. As will be understood by one skilled in the art, the mechanical CPR device 100 may include additional components not shown in FIG. 1. The mechanical CPR device 100 includes a controller 102, which may be in electrical communication with a chest compression mechanism or device 104. The chest compression mechanism 104 may be any component that compresses a chest of a patient, such as a piston based chest compression device or a belt driven device that wraps around a chest of a patient.

The embodiment shown in FIG. 1 includes a piston 106 and a contact member 154. Contact member 154 can include a suction cup, a compression pad, or other device configured to make contact with a patient's chest. The chest compression mechanism 104 can further include a contact surface 116 configured to make contact with a patient's chest. The contact surface 116 can be disposed on the piston 106 or the contact member 154. The chest compression mechanism 104 further can include retention structure 108 including one or more legs 110 and/or a support portion 112 configured to be placed underneath a patient 114.

The chest compression mechanism 104 may include a driver 118 configured to drive the compression mechanism 104 to cause the compression mechanism 104 to perform compressions to a chest of patient 114. The controller 102, as will be discussed in more detail below, provides instructions to the chest compression mechanism 104 to operate the chest compression mechanism 104 at a number of different rates, depths, duty cycles. Controller 102 further provides instructions to the chest compression mechanism 104 to alter the orientation of the contact surface 116 and move one or more legs 110 into a new position.

The controller 102 may include a processor 120, which may be implemented as any processing circuity, such as, but not limited to, a microprocessor, an application specific integration circuit (ASIC), programmable logic circuits, etc. The controller may further include a memory 122 coupled with the processor 120. Memory can include a non-transitory storage medium that includes programs 124 configured to be read by the processor 120 and be executed upon reading. The processor 120 is configured to execute instructions from memory 122 and may perform any methods and/or associated operations indicated by such instructions. Memory 122 may be implemented as processor cache, random access memory (RAM), read only memory (ROM), solid state memory, hard disk drive(s), and/or any other memory type. Memory 122 acts as a medium for storing data 126, such as event data, patient data, etc., computer program products, and other instructions.

Controller 102 may further include a communication module 128. Communication module 128 may transmit data to a post-processing module 130. Alternately, data may also be transferred via removable storage such as a flash drive. While in module 130, data can be used in post-event analysis. Such analysis may reveal how the CPR machine was used, whether it was used properly, and to find ways to improve future sessions, etc.

Communication module 128 may further communicate with other medical device 132. Other medical device 132 can be a defibrillator, a monitor, a monitor-defibrillator, a ventilator, a capnography device, or any other medical device. Communication between communication module 128 and other medical device 132 could be direct, or relayed through a tablet or a monitor-defibrillator. Therapy from other device 132, such as ventilation or defibrillation shocks, can be coordinated and/or synchronized with the operation of the CPR machine. For example, compression mechanism 104 may pause the compressions for delivery of a defibrillation shock, afterwards detection of ECG, and the decision of whether its operation needs to be restarted. For instance, if the defibrillation shock has been successful, then operation of the CPR machine might not need to be restarted.

The controller 102 may be located separately from the chest compression mechanism 104 and may communicate with the chest compression mechanism 104 through a wired or wireless connection 134. The controller 102 also electrically communicates with a user interface 136. As will be understood by one skilled in the art, the controller 102 may also be in electronic communication with a variety of other devices, such as, but not limited to, another communication device, another medical device, etc.

The chest compression mechanism 104 may include one or more sensors configured to transmit information to controller 102. For example, chest compression mechanism 104 can include a physiological parameter sensor 138 for sensing a physiological parameter of a patient and to output a physiological parameter sensor signal 140 that is indicative of a dynamic value of the parameter. The physiological parameter can be an Arterial Systolic Blood Pressure (ABSP), a blood oxygen saturation (SpO2), a ventilation measured as End-Tidal CO2 (ETCO2), a temperature, a detected pulse, etc. In addition, this parameter can be what is detected by defibrillator electrodes that may be attached to patient, such as ECG and impedance.

In some embodiments, controller 102 can receive the physiological parameter sensor signal 140 from the physiological parameter sensor 138 and determine whether a first orientation of the contact surface 116 should be adjusted based on the physiological parameter sensor signal 140. Controller 102 can, responsive to a determination that the first orientation of contact surface 116 should be adjusted, cause contact surface 116 to move so that contact surface 116 makes contact with the chest at a second orientation. Additionally and/or alternatively, controller 102 can, responsive to a determination that the first orientation of contact surface 116 should be adjusted, cause one or more legs 110 to move from a first position to a second position so that contact surface 116 makes contact with the chest at a second orientation.

Additionally and/or alternatively, the chest compression mechanism can include a pressure sensor 150 configured to sense area(s) of pressure of the contact surface with the patient's chest and to output a pressure signal 152, which is indicative of a dynamic value of pressure against the patient's chest. In some embodiments, controller 102 can receive the pressure signal 152 from the pressure sensor 150 and determine whether a first orientation of the contact surface 116 should be adjusted based on the pressure signal 152. Controller 102 can, responsive to a determination that the first orientation of contact surface 116 should be adjusted, cause contact surface 116 to move so that contact surface 116 makes contact with the chest at a second orientation. Additionally and/or alternatively, controller 102 can, responsive to a determination that the first orientation of contact surface 116 should be adjusted, cause one or more legs 110 to move from a first position to a second position so that contact surface 116 makes contact with the chest at a second orientation.

Additionally and/or alternatively, the chest compression mechanism can include an angle sensor 142 configured to sense the orientation of the contact surface and to output an angle signal 144, which is indicative of a dynamic value of the orientation of the contact surface. Additionally and/or alternatively, the chest compression mechanism can include an angle sensor 146 configured to sense an angle of the at least one leg 110 with respect to the support portion 112 and to output an angle signal 148, which is indicative of a dynamic value of the angle of the at least one leg 110.

Operations of the mechanical CPR device 100 may be effectuated through the user interface 136. The user interface 136 may be external to or integrated with a display. For example, in some embodiments, the user interface 136 may include physical buttons located on the mechanical CPR device 100, while in other embodiments, the user interface 136 may be a touch-sensitive feature of a display. The user interface 136 may be located on the mechanical CPR device 100, or may be located on a remote device, such as a smartphone, tablet, PDA, and the like, and is also in electronic communication with the controller 102. In some embodiments, controller 102 can receive an input from the user interface 136 and determine whether a first orientation of the contact surface 116 should be adjusted based on the input. Controller 102 can, responsive to a determination that the first orientation of contact surface 116 should be adjusted, cause contact surface 116 to move so that contact surface 116 makes contact with the chest at a second orientation. Additionally and/or alternatively, controller 102 can, responsive to a determination that the first orientation of contact surface 116 should be adjusted, cause one or more legs 110 to move from a first position to a second position so that contact surface 116 makes contact with the chest at a second orientation.

Additionally and/or alternatively, in some embodiments controller 102 can receive input from the other medical device 132 and determine whether a first orientation of the contact surface 116 should be adjusted based on the input. Controller 102 can, responsive to a determination that the first orientation of contact surface 116 should be adjusted, cause contact surface 116 to move so that contact surface 116 makes contact with the chest at a second orientation. Additionally and/or alternatively, controller 102 can, responsive to a determination that the first orientation of contact surface 116 should be adjusted, cause one or more legs 110 to move from a first position to a second position so that contact surface 116 makes contact with the chest at a second orientation. In some embodiments, the other medical device can be a device used to measure or calculate a patient's sternal angle.

During a CPR session of compressions, controller 102 can move the contact surface 116 and/or the one or more legs 110 periodically, according to a schedule, responsive to an input by an operator to a user interface, and/or responsive to a signal from one or more of sensors as described above. Movement of the contact surface 116 and/or the one or more legs 110 can be at any point during a CPR session and can occur a number of times turning a CPR session. For example, the orientation of the contact surface 116 can be changed at the beginning of the CPR session and again before the end of the CPR session, if, for example, the patient's sternal angle has changed during the CPR session.

Figure 2:
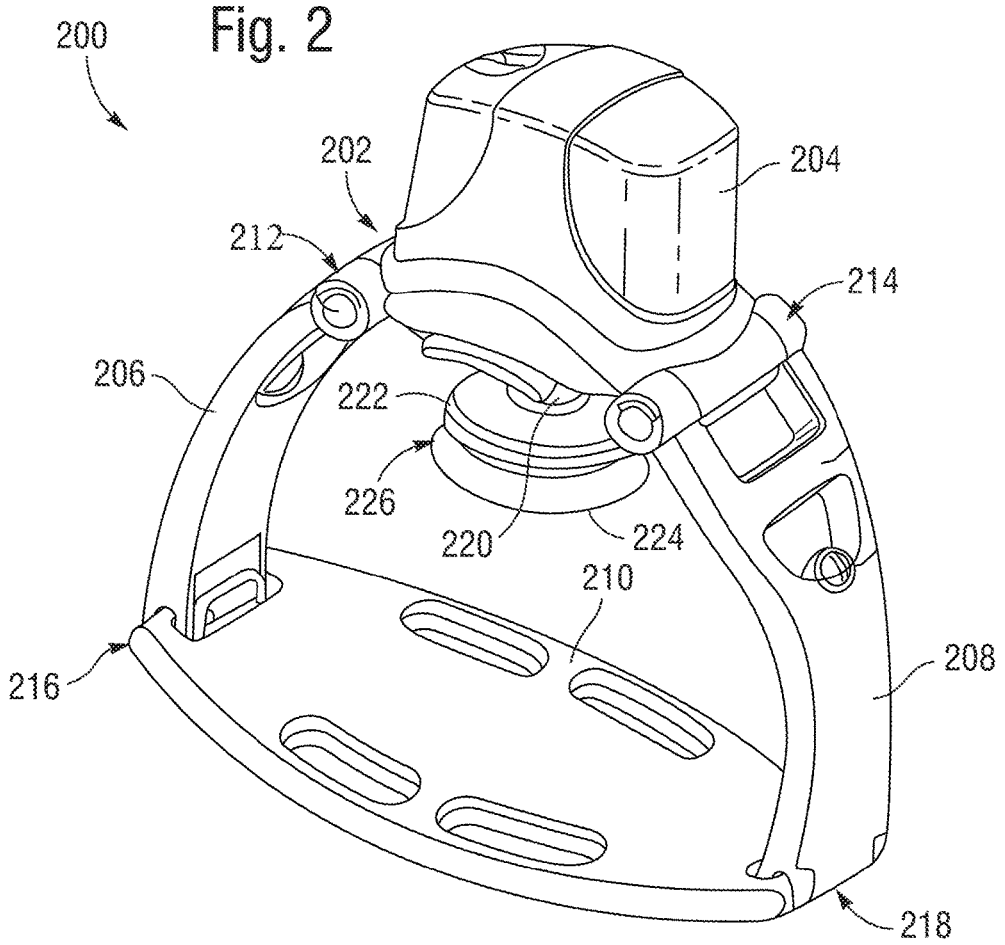
FIG. 2 is an exemplary CPR chest compression system including a piston and a suction cup according to the present disclosure.

FIG. 2 shows a CPR system 200 including a retention structure 202. The retention structure 202 includes a central member 204, a first leg 206, a second leg 208, and a support portion 210 configured to be placed underneath a patient. Central member 204 is coupled with first leg 206 and with second leg 208 via joints 212 and 214, respectively. In addition, the far ends of legs 206, 208 can become coupled with edges 216, 218 of support portion 210. These couplings form the retention structure 202 that retains a patient. In this particular case, central member 204, first leg 206, second leg 208 and support portion 210 form a closed loop, in which the patient is retained.

Central member 204 includes a battery that stores energy, a motor that receives the energy from the battery, and a compression mechanism that can be driven by the motor. The compression mechanism is driven up and down by the motor using a rack and pinion gear. The compression mechanism includes a piston 220 that emerges from central member 204, and can compress and release the patient's chest. Piston 220 is sometimes called a plunger. Here, piston 220 terminates in a contact member 222 having a contact surface 224. The contact member 222 can include a suction cup 226. In this case the battery, the motor and the rack and pinion gear are not shown, because they are completely within a housing of central member 204.

As described in further detail below, in some embodiments one or more of first leg 206 and second leg 208 can be pivotally attached to the support portion 210. For example, both first leg 206 and second leg 208 can be pivotally attached to the support portion 210 such that when first leg 206 and second leg 208 are hingedly moved or tilted with respect to the support portion 210, the central member 204, piston 220 and contact surface 224 are also moved or tilted with respect to the support portion 210.

Figure 3A:
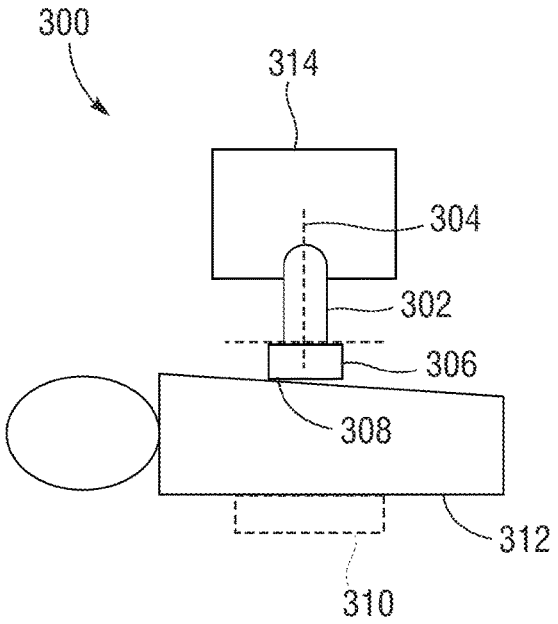
FIG. 3A is a side view of a portion of a CPR chest compression system having a piston and a contact surface in a first orientation in accordance with the present disclosure.
Figure 3B:
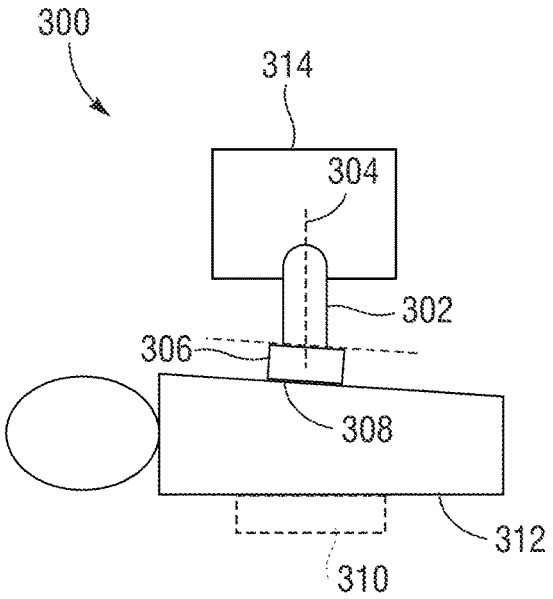
FIG. 3B is a side view of the piston and contact surface of FIG. 3A in a second orientation in accordance with the present disclosure.

Turning now to FIGS. 3A-3B, as discussed above CPR patients have different sternal angles, leading to potential for a CPR device, despite having a depth of compressions in accordance with guidelines, to provide too deep of compressions that could exert internal organ damage or too shallow of compressions that would impair organ perfusion. FIG. 3A shows a side view of select components of a CPR system including a compression mechanism 300 having a piston 302 with a piston central axis 304, a contact member 306 having a contact surface 308, a support portion 310 configured to be placed underneath a patient 312, and a central member 314. The contact surface 308 is at a first orientation with respect to the support portion 310 and/or piston central axis 304 in FIG. 3A. As shown, the contact surface 308 is not substantially flush with the patient's chest and the compressive force of the compression mechanism is perpendicular to the support portion 310, not the patient's chest, because the sternal angle is not parallel to the contact surface 308. Therefore, if the pressure for a compression during a CPR session is strictly perpendicular, even if a CCCM is set to perform each compression at a fixed depth, the inner movement (deflection of the sternum) will be different in different patients depending on the length and angle of the sternum, the size of the pressure point and the pressure point's location from the sternum's fulcrum during a compression.

FIG. 3B shows the side view of FIG. 3A, wherein the contact surface 308 is at a second orientation with respect to the support portion 310 and/or piston central axis 304. As shown, in the second orientation, the contact surface 308 is not parallel with the support surface 310. In the second orientation, the contact surface 308 is substantially flush with the patient's chest and the compressive force is substantially perpendicular to the patient's chest. In the second orientation, the desired compression depth will be more accurate for the patient.

Figure 4A:
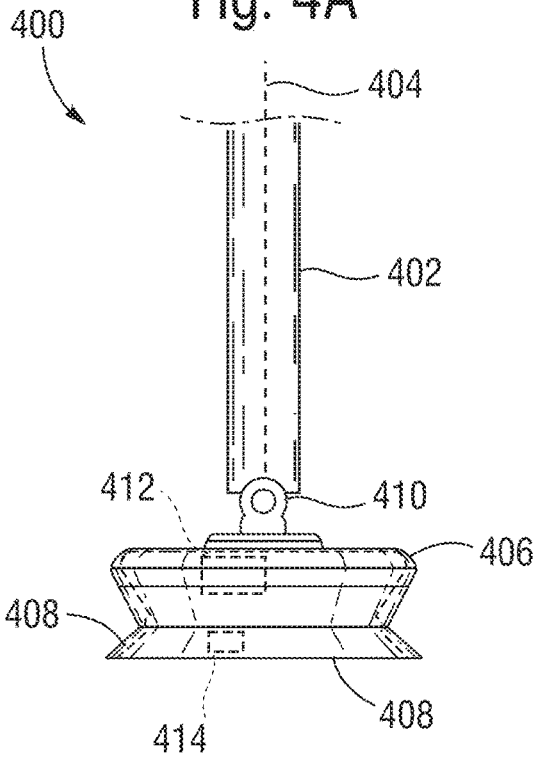
FIG. 4A is a partial view of a piston and a contact surface in a first orientation in accordance with the present disclosure.
Figure 4B:
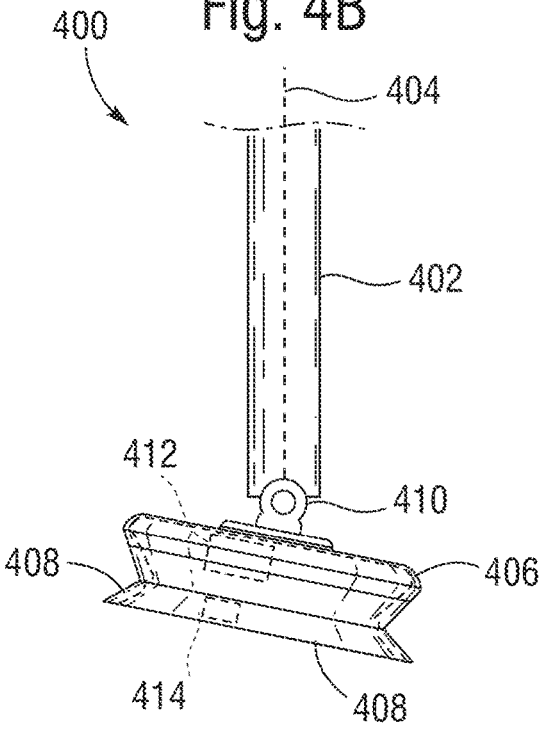
FIG. 4B is a partial view of the piston and contact surface of FIG. 4A in a second orientation in accordance with the present disclosure.

FIG. 4A shows a partial view of a compression mechanism 400 including a piston 402 having a piston center axis 404 and a contact member 406 having a contact surface 408 in a first orientation with respect to the piston center axis 404. FIG. 4B shows the contact surface 408 in a second orientation with respect to the piston center axis 404. The contact member 406 can include a suction cup 408. The contact member 406 is pivotally attached to the piston 402 via a pivot attachment 410. Examples of the pivot attachment 410 include but are not limited to a hinge joint and a ball joint. The compression mechanism 400 can further include an angle sensor 412 configured to sense the orientation of the contact surface 408 with respect to the piston center axis 404. Additionally and/or alternatively, the compression mechanism 400 can include one or more pressure sensors 414 configured to generate pressure sensor signals, the pressure sensor signals representative of contact with a patient's chest.

Figure 5A:
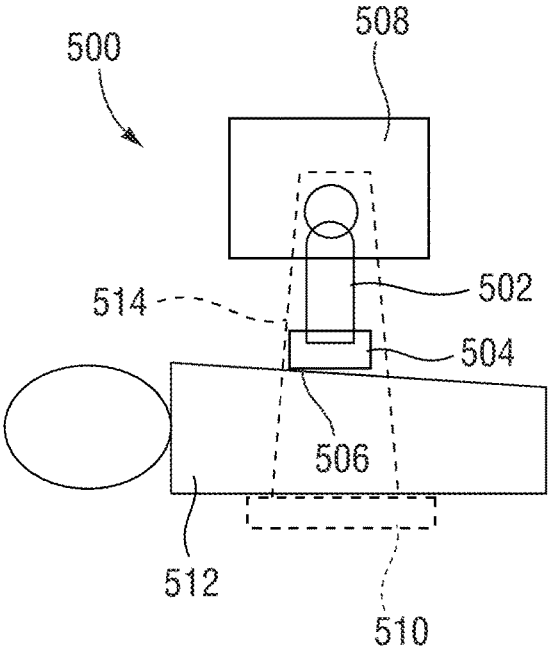
FIG. 5A is a side view of a portion of a CPR chest compression system having a piston and a contact surface in a first orientation and a leg in a first positon in accordance with the present disclosure.
Figure 5B:
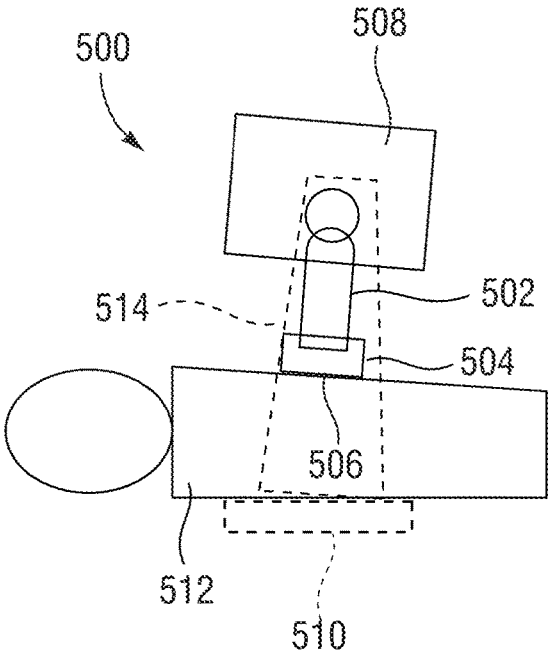
FIG. 5B is a side view of the CPR chest compression system of FIG. 5A with the piston and contact surface in a second orientation and the leg in a second position in accordance with the present disclosure.

Turning now to FIGS. 5A-5B, FIG. 5A shows a side view of select components of a CPR system including a compression mechanism 500 having a piston 502, a contact member 504 having a contact surface 506, a central member 508, a support portion 510 configured to be placed underneath a patient 512 and at least one leg 514 pivotally attached to the support portion 510. The at least one leg 514 is in a first position and the contact surface 506 is at a first orientation with respect to the support portion 510. As shown, the contact surface 506 is not substantially flush with the patient's chest and the compressive force of the compression mechanism is perpendicular to the support portion 510, not the patient's chest, because the sternal angle is not parallel to the contact surface 506.

FIG. 5B shows the side view of FIG. 5A, wherein the at least one leg 514 is in a second position. Movement of the at least one leg 514 has caused corresponding movement of the central member 508, piston 502 and contact surface 506 such that the contact surface 506 is at a second orientation with respect to the support portion 510. As shown, in the second orientation, the contact surface 506 is substantially parallel with the patient's chest. In the second orientation, the contact surface 506 is substantially flush with the patient's chest and the compressive force is substantially perpendicular to the patient's chest.

Figure 6A:
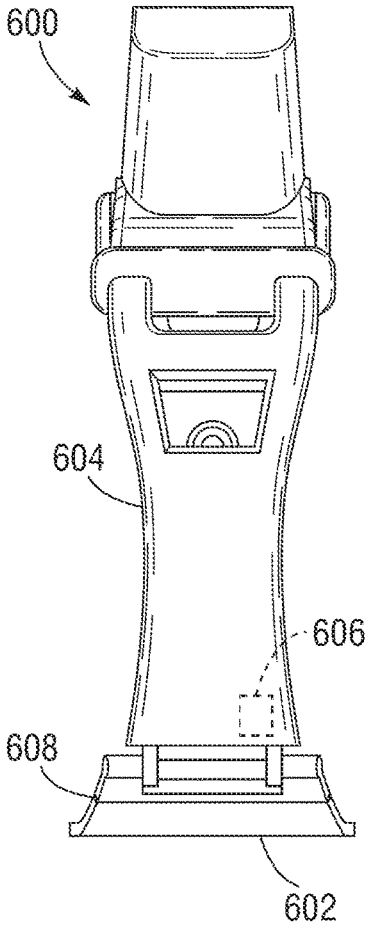
FIG. 6A is a partial view of a support portion and a leg in a first position in accordance with the present disclosure.
Figure 6B:
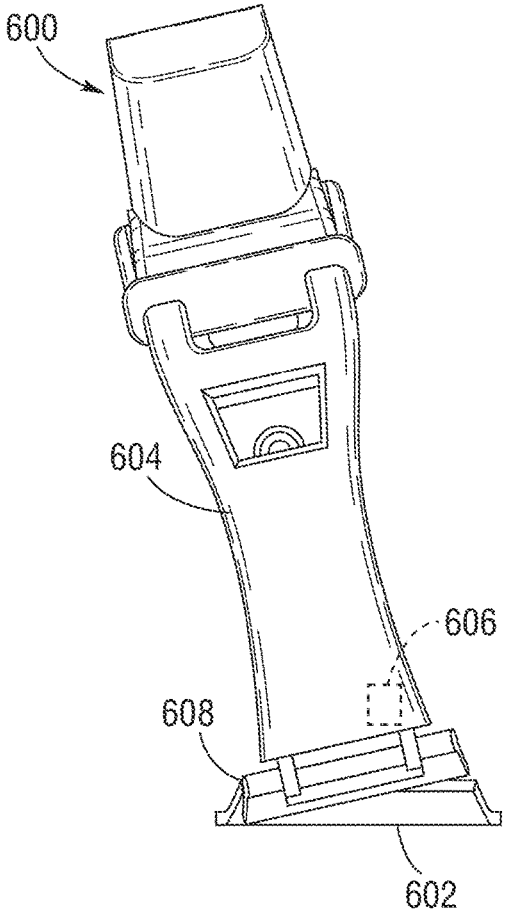
FIG. 6B is a partial view of the support portion and leg of FIG. 6A with the leg in a second position in accordance with the present disclosure.

FIG. 6A shows a partial view of a compression mechanism 600 including a support portion 602 configured to be placed underneath a patient and at least one leg 604 pivotally attached to the support portion 602, for example via one of a hinge joint 608 and a ball joint. The at least one leg 604 is in a first position in FIG. 6A. In FIG. 6B, the at least one leg 604 is in a second position. The compression mechanism 600 can further include an angle sensor 606 configured to sense an angle of the at least one leg 604 with respect to the support portion 602.

Figure 7A:
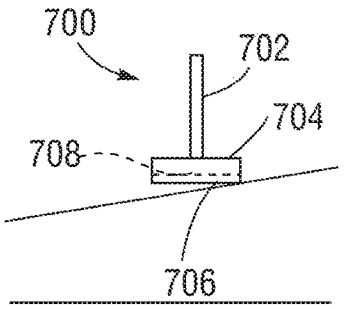
FIGS. 7A-7C show partial views of a compression mechanism including a piston and a contact member having a contact surface.
Figure 7B:
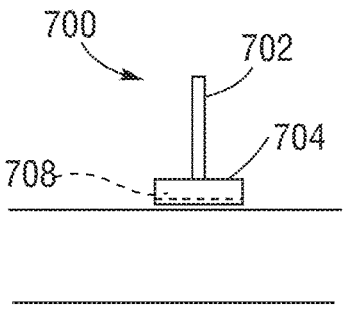
Figure 7C:
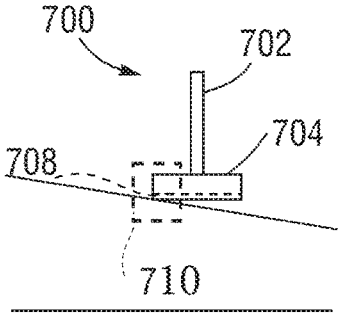

FIGS. 7A-7C show partial views of a compression mechanism 700 including a piston 702 and a contact member 704 having a contact surface 706. The contact surface may include one or more pressure sensors 708 that can span the entirety of the contact surface. FIGS. 7A-7C further show the areas of contact between the contact surface and a patient's chest depending on the sternal angle of the patient's chest (see exemplary area of contact 710 in FIG. 7C). The one or more pressure sensors can be configured to generate a pressure sensor signal, the pressure sensor signal representative of contact with a patient's chest. The pressure sensor signal can be sent to the controller (not shown) for determination of whether the orientation of the contact surface with respect to the support portion or the piston center axis should be adjusted based on the pressure sensor signal.

The devices and/or systems made according to embodiments perform functions, processes and/or methods, as described in this document. These functions, processes and/or methods may be implemented by one or more devices that include logic circuitry, such as was described for controller 102.

Moreover, methods and algorithms are described below. This detailed description also includes flowcharts, display images, algorithms, and symbolic representations of program operations within at least one computer readable medium. An economy is achieved in that a single set of flowcharts is used to describe both programs, and also methods. So, while flowcharts describe methods in terms of boxes, they also concurrently describe programs. A method is now described.

Figure 8:
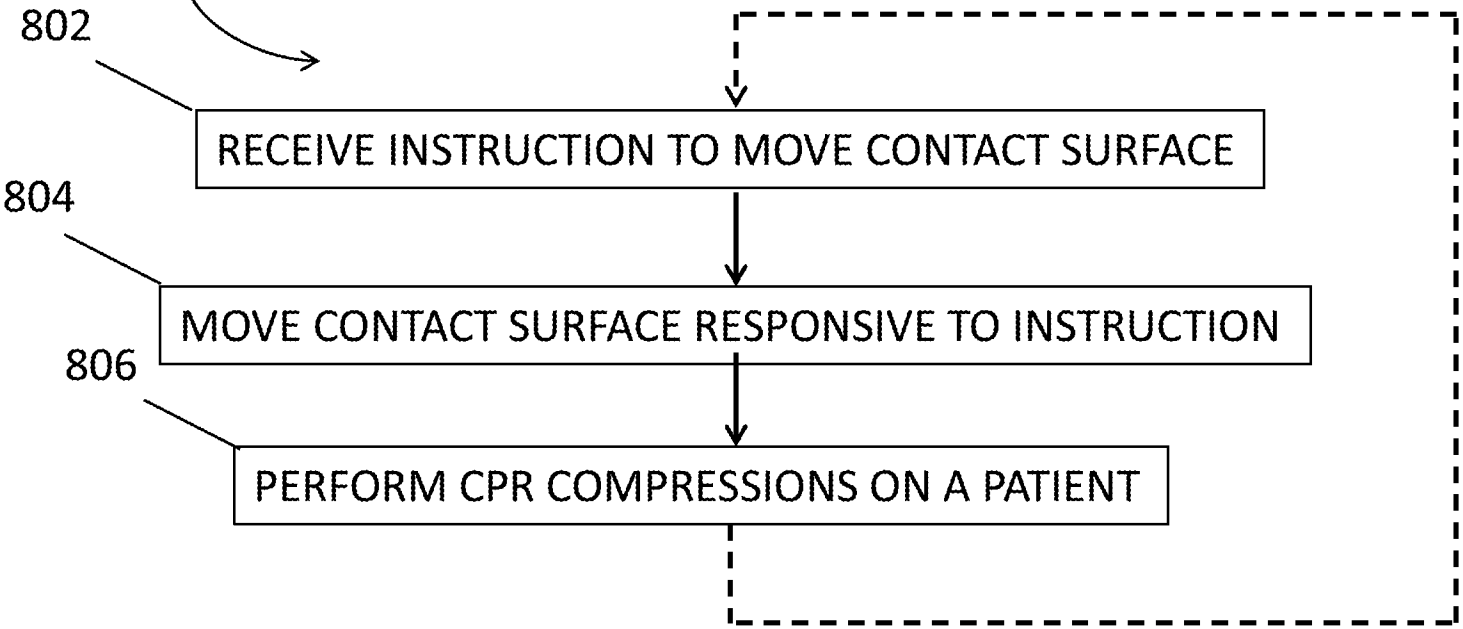
FIG. 8 is a flow chart illustrating methods of CPR according to the present disclosure.

FIG. 8 shows a flowchart 800 for describing methods according to embodiments. The methods of flowchart 800 may also be practiced by embodiments described elsewhere in this document for performing automatically a series of successive compressions to a chest of a patient.

A compression mechanism of a CPR device is used to perform successive CPR compressions on a chest of a patient. The compression mechanism may include a piston and a contact surface configured to make contact with the chest at a first orientation. At step 802, the CPR device receives an instruction to move the contact surface to a second orientation. The instruction may be based at least in part on at least one physiological parameter determined by the CPR device, a pressure sensor signal, an input from an other medical device, an input provided by a user, or a combination thereof.

At step 804, the CPR device, responsive to receiving the instruction, may cause the contact surface to be moved from the first orientation to the second orientation. For example, the contact surface may be disposed on a contact member pivotally connected to the piston. The CPR device may cause the contact member to pivot with respect to piston. Additionally and/or alternatively, the CPR device can include a support portion and at least one leg pivotally connected to the support portion having a first position in which the contact surface is in the first orientation, and a second position in which the contact surface is in the second orientation. The CPR device may cause the at least one leg to move from the first positon to the second position.

At step 806, the CPR device may receive instruction to perform CPR compressions on the patient. In some embodiments, the method may return to step 802 for further refinement of the orientation of the contact surface during a CPR session, for example if a patient's sternal angle changes during a CPR session.

Aspects of the disclosure may operate on particularly created hardware, firmware, digital signal processors, or on a specially programmed computer including a processor operating according to programmed instructions. The terms controller or processor as used herein are intended to include microprocessors, microcomputers, Application Specific Integrated Circuits (ASICs), and dedicated hardware controllers. One or more aspects of the disclosure may be embodied in computer-usable data and computer-executable instructions, such as in one or more program modules, executed by one or more computers (including monitoring modules), or other devices. Generally, program modules include routines, programs, objects, components, data structures, etc. that perform particular tasks or implement particular abstract data types when executed by a processor in a computer or other device. The computer executable instructions may be stored on a computer readable storage medium such as a hard disk, optical disk, removable storage media, solid state memory, Random Access Memory (RAM), etc. As will be appreciated by one of skill in the art, the functionality of the program modules may be combined or distributed as desired in various aspects. In addition, the functionality may be embodied in whole or in part in firmware or hardware equivalents such as integrated circuits, FPGA, and the like. Particular data structures may be used to more effectively implement one or more aspects of the disclosure, and such data structures are contemplated within the scope of computer executable instructions and computer-usable data described herein.

The disclosed aspects may be implemented, in some cases, in hardware, firmware, software, or any combination thereof. The disclosed aspects may also be implemented as instructions carried by or stored on one or more or computer-readable storage media, which may be read and executed by one or more processors. Such instructions may be referred to as a computer program product. Computer-readable media, as discussed herein, means any media that can be accessed by a computing device. By way of example, and not limitation, computer-readable media may comprise computer storage media and communication media.

Computer storage media means any medium that can be used to store computer-readable information. By way of example, and not limitation, computer storage media may include RAM, ROM, Electrically Erasable Programmable Read-Only Memory (EEPROM), flash memory or other memory technology, Compact Disc Read Only Memory (CD-ROM), Digital Video Disc (DVD), or other optical disk storage, magnetic cassettes, magnetic tape, magnetic disk storage or other magnetic storage devices, and any other volatile or nonvolatile, removable or non-removable media implemented in any technology. Computer storage media excludes signals per se and transitory forms of signal transmission.

Communication media means any media that can be used for the communication of computer-readable information. By way of example, and not limitation, communication media may include coaxial cables, fiber-optic cables, air, or any other media suitable for the communication of electrical, optical, Radio Frequency (RF), infrared, acoustic or other types of signals.

The previously described versions of the disclosed subject matter have many advantages that were either described or would be apparent to a person of ordinary skill. Even so, these advantages or features are not required in all versions of the disclosed apparatus, systems, or methods.

Additionally, this written description makes reference to particular features. It is to be understood that the disclosure in this specification includes all possible combinations of those particular features. Where a particular feature is disclosed in the context of a particular aspect or example, that feature can also be used, to the extent possible, in the context of other aspects and examples.

Also, when reference is made in this application to a method having two or more defined steps or operations, the defined steps or operations can be carried out in any order or simultaneously, unless the context excludes those possibilities.

Although specific examples of the invention have been illustrated and described for purposes of illustration, it will be understood that various modifications may be made without departing from the spirit and scope of the invention. Accordingly, the invention should not be limited except as by the appended claims.

What is claimed:

1. A Cardio-Pulmonary Resuscitation ("CPR") device, comprising:

a compression mechanism configured to perform successive CPR compressions on a chest of a patient, the compression mechanism including a support portion configured to be placed underneath a patient, a piston, and a contact member pivotally attached to the piston having a contact surface configured to make contact with the chest at a first orientation with respect to the support portion;

a controller communicatively coupled with the compression mechanism, the controller configured to:

receive at least one input;

determine whether the first orientation of the contact surface should be adjusted based on the at least one input;

responsive to a determination that the first orientation of the contact surface should be adjusted, cause the contact member to pivot relative to the piston to move the contact surface so that the contact surface makes contact with the chest at a second orientation with respect to the support portion; and at least one leg pivotally attached to the support portion, wherein the at least one leg has a first position and a second position, further wherein at the first position the contact surface is configured to make contact with a patient's chest at the first orientation and at the second position the contact surface is configured to make contact with the patient's chest at the second orientation.

2. The CPR device of claim 1, wherein the at least one input includes a physiological parameter sensor signal from a physiological parameter sensor for sensing a physiological parameter of a patient.

3. The CPR device of claim 1, wherein the at least one input is an input provided by a user.

4. The CPR device of claim 1, wherein the compression mechanism includes a pressure sensor configured to generate a pressure sensor signal, the pressure sensor signal representative of contact with the patient's chest at the first orientation, and further wherein the at least one input includes the pressure sensor signal.

5. The CPR device of claim 1, further comprising an angle sensor, wherein the piston includes a piston center axis and the angle sensor is configured to sense an orientation of the contact surface with respect to the piston axis.

6. The CPR device of claim 1, further comprising an angle sensor configured to sense an orientation of the at least one leg with respect to the support portion.

7. The CPR device of claim 1, wherein the contact member includes a suction cup attached to the contact surface.

8. The CPR device of claim 7, wherein the suction cup is removably attached to the contact surface.

9. The CPR device of claim 1, further comprising a hinge joint pivotally attaching the contact member to the piston.

10. The CPR device of claim 1, further comprising a ball joint pivotally attaching the contact member to the piston.

11. The CPR device of claim 1, further comprising an angle sensor configured to sense orientation of the contact surface with respect to the support portion.

12. The CPR device of claim 1, further comprising a pressure sensor configured to generate a pressure sensor signal representative of contact with the patient's chest at the first orientation.

13. The CPR device of claim 1, further comprising an angle sensor configured to sense whether the at least one leg is in the first position or the second position.

* * * * *